US006148826A

United States Patent [19]

Lancaster et al.

[11] Patent Number: 6,148,826

[45] Date of Patent: Nov. 21, 2000

[54] GLASS BAT

[76] Inventors: Ronald Boyd Lancaster, P.O. Box 1033, Pell Lake, Wis. 53157; Lewis James Danforth, P.O. Box 926, Delavan, Wis. 53115

[21] Appl. No.: 09/042,708

[22] Filed: Mar. 16, 1998

[51] Int. Cl.[7] ..... A24F 1/28

[52] U.S. Cl. ..... 131/191; 131/330; 206/244

[58] Field of Search ..... 131/191, 330, 131/180; 206/244

[56] References Cited

U.S. PATENT DOCUMENTS

| | | | |
|---|---|---|---|
| 163,976 | 6/1875 | Cook . | |
| D. 177,602 | 5/1956 | Wang | D85/8 |
| 201,031 | 3/1878 | McCarter . | |
| 3,709,233 | 1/1973 | Stelitano | 131/176 |
| 4,214,658 | 7/1980 | Crow | 206/244 |
| 4,286,607 | 9/1981 | Claessens | 131/328 |
| 4,289,149 | 9/1981 | Kyriakou | 131/175 |
| 4,328,795 | 5/1982 | Cabaniss, III | 131/180 |
| 5,065,766 | 11/1991 | Lawson et al. | 131/365 |

*Primary Examiner*—Stanley S. Silverman
*Assistant Examiner*—Steven B. Leavitt
*Attorney, Agent, or Firm*—Akin, Gump, Strauss, Hauer & Feld, L.L.P.

[57] ABSTRACT

A device for smoking combustible materials includes a tubular body member constructed entirely of heat-resistant glass material. The device has an internal bore with an integrally formed venturi that separates the bore into a smoke chamber and a loading chamber. A method of forming the device includes providing a tubular body member constructed entirely from a heat-resistant glass material; forming a constricted passage in a bore of the tubular body member by applying heat to a predetermined location on the tubular body member until the glass material expands into the bore at the predetermined location; and smoothing the outer surface of the tubular body member at the predetermined location.

12 Claims, 2 Drawing Sheets

GLASS BAT

BACKGROUND OF THE INVENTION

1. Field of the Invention

This invention relates to smokeless pipes, and more particularly to a smokeless pipe constructed of glass and its method of manufacture.

2. Description of the Related Art

Most smoking systems include a container that houses both a metallic smoking pipe and a quantity of tobacco for use with the pipe. Such systems are typically used by consumers who desire less tobacco than offered by cigarettes, and wish to consume a more refined tobacco.

U.S. Pat. No. 4,214,658 issued to Crow on Jul. 29, 1980 discloses a smoking system comprising a container that has a first compartment for receiving a smoking pipe and a second compartment for receiving and storing the quantity of tobacco. A cover slides over the open end of each compartment to hold the pipe and tobacco in place when not in use. The pipe includes a bowl with a sharp lower edge for cutting away excess smoking material when the pipe is forced against the bottom of the tobacco storage compartment. The bowl is pressed into the tobacco and the pipe is moved up and down until the bowl is filled with smoking material.

The metallic material in these types of pipes is not as desirable as other materials, such as glass. Certain types of glass are well known for their heat insulative qualities and their ability to be repeatedly cleaned and sterilized. Heretofore, the successful production of smokeless pipes constructed of glass material was unknown.

SUMMARY OF THE INVENTION

According to the invention, a device for smoking combustible materials comprises a tubular body member having a longitudinal axis, a mouth end portion and a loading end portion opposite the mouth end portion, with a bore extending through the tubular body member between the mouth end portion and the loading end portion. The bore is preferably coaxial with the longitudinal axis. A ring is formed unitary with the tubular body member in the bore and separates the bore into a smoke chamber and a loading chamber that are both coaxial with the longitudinal axis. The ring defining a constricted passage between the smoke chamber and loading chamber. In a preferred arrangement, the tubular body member is constructed entirely from a heat-resistant glass material.

Further according to the invention, a method of forming a device for smoking combustible materials comprises providing a tubular body member constructed entirely from a heat-resistant glass material; forming a constricted passage in a bore of the tubular body member by applying heat to a predetermined location on the tubular body member until the glass material expands into the bore at the predetermined location; and smoothing the outer surface of the tubular body member at the predetermined location. With this arrangement, the constricted passage separates the bore into a coaxial smoke chamber and a loading chamber.

DETAILED DESCRIPTION OF THE PREFERRED EMBODIMENT

Figure 1:
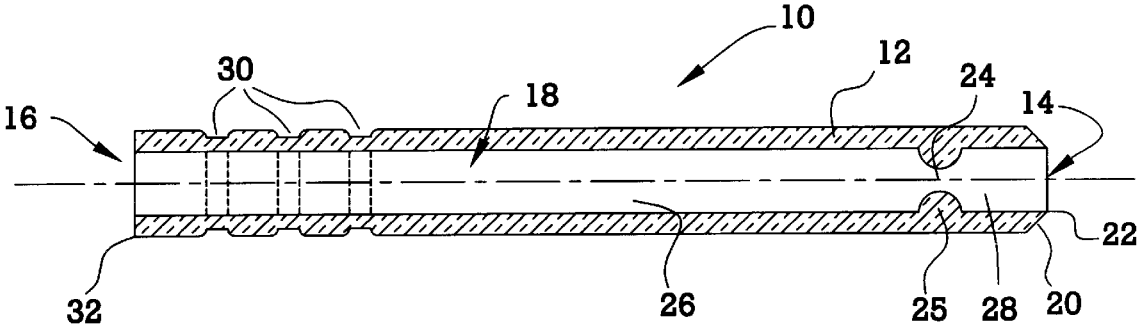
FIG. 1 is a cross sectional view of the smokeless pipe according to the invention.
Figure 2:
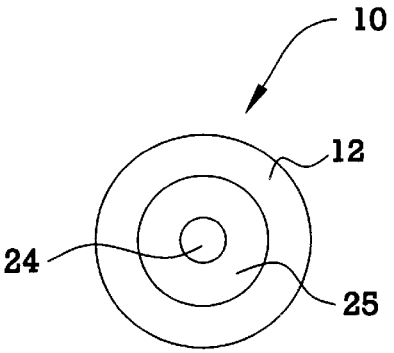
FIG. 2 is a front elevational view of the smokeless pipe.
Figure 3:
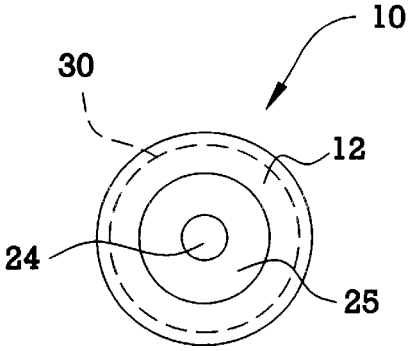
FIG. 3 is a rear elevational view of the smokeless pipe.

Referring now to the drawings, and to FIGS. 1–3 in particular, a smokeless pipe or bat 10 includes a substantially tubular member 12 that includes a forward or loading end portion 14 and a rearward or mouth end portion 16. A bore 18 extends through the tubular member 12 from the forward end portion to the rearward end portion. The forward end portion 14 includes an annular beveled surface 20 that extends between the outer surface of the tubular member 12 and the bore 18. A cutting edge is formed at the intersection of the bore 18 and beveled surface 20. An inner annular ring 25 is formed in the bore 26 proximal the forward end portion 14. The annular ring 25 defines a constricted passage or venturi 24 and separates the bore 18 into a rearward smoke chamber 26 and a forward loading chamber 28. The rearward and forward chambers are fluidly connected to each other through the venturi. Annular grooves 30 are formed in the outer surface 32 of the tubular member 12 and serve as gripping means for a user.

Preferably, the pipe 10 is formed from a single piece of thick-walled glass tubing. A suitable glass material is Pyrex®, a borosilicate glass known for its relatively high melting point and excellent stability characteristics.

In a preferred embodiment, the pipe is approximately three and three-eighths inches long and has an outer diameter of about three-eighths inch. The center of the venturi 24 is preferably located about three-eighths inch from the cutting edge 22, while the venturi opening is approximately 3⁄32 inch in diameter. The rings 30 are preferably spaced about one-quarter inch apart, with the ring closest to the outer edge 32 of the rearward end portion 16 being spaced approximately one-quarter inch therefrom. The bevel 20 preferably extends at an angle of about 45° with respect to a longitudinal axis of the tube. Although the above dimensions are preferred, it is to be understood that the invention is not limited thereto, as other dimensions may alternatively be used.

Figure 4:
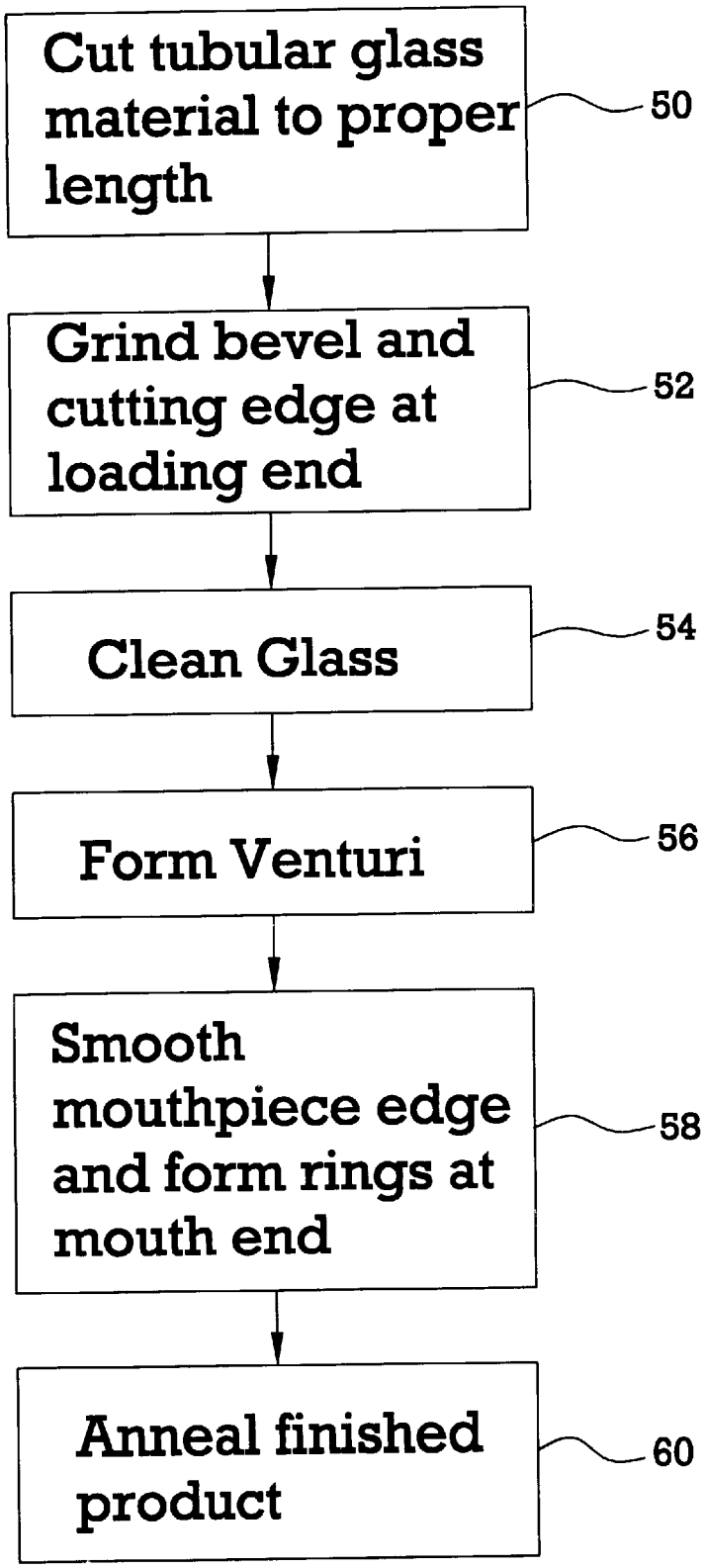
FIG. 4 is a schematic diagram illustrating a method of forming the smokeless pipe according to the invention.

With reference now to FIG. 4, a method of forming the glass pipe 10 is illustrated. As shown in block 50, the heavy-walled glass tubing is first cut to the desired length, preferably by a wet saw that is typically used in cutting glass or tile. A wet saw having a 220 grit diamond cutting blade is adequate for performing the cutting operation.

Subsequently, the cut tubing is mounted in a turret or chuck that is capable of swiveling through 90°. The turret or chuck is motorized and causes the tubing to spin around its longitudinal axis. The cut tubing is then swivelled into the path of a belt sander or grinder that is positioned to contact the forward end portion 14 of the cut tubing at a 45° angle to thereby grind the bevel 20 and form the cutting edge 22, as shown in block 52. It is to be understood that both the tubing and the belt sander or grinder are spinning, preferably in opposite directions, during this operation. Also, a coolant may be used during the cutting or grinding. A diamond abrasive belt or grinding wheel of approximately 120–150 grit is adequate for grinding the bevel 20.

As shown by block 54, the tubing is then washed in steam-distilled water and allowed to dry.

In block 56, the venturi 25 is then formed. This is accomplished by mounting the tubing again in the collet with the forward end portion 14 protruding outward. The tubing is then spun about its longitudinal axis, preferably at a low rpm. A heat source capable of producing a concentrated, high temperature heat is then applied to the spinning tubing at the location where it is desired to form the venturi. Preferably, the heat source includes a handheld torch with a #1 tip, a propane supply set at 5 psi and an oxygen supply set at 10 psi to produce a very fine flame. The torch is held such that the flame is directed to one spot on the spinning tubing. After about 40 seconds, the outer diameter of the tubing begins to slightly swell while the inner diameter begins to slightly shrink. At that point, the torch is removed and a graphite paddle is simultaneously applied with a light touch to the underside of the spinning tubing until the glass is smooth and true. At this point, the bevel 20 may be firepolished for a more desirable clear finish.

After cooling (which should not be less than 65° F.), the forward end portion 14 of the tubing is placed in the turret to smooth the outer edge 32 of the rearward end portion 16 and to form the rings 30, as shown by block 58. The tubing is again spun about its longitudinal axis at a low rpm. The same heat source used for forming the venturi is then applied to the very outer edge 32 of the rearward end portion 16 until the glass is orange in color. A graphite paddle is then applied to smooth the edge 32. Subsequently, the heat source is applied to the spinning tubing at the location where it is desired to form one of the rings 30. Simultaneously, a sharpened one-eighth inch graphite rod is applied to the same location. After about seven seconds, the ring is formed. The remainder of the rings are then formed in the same manner.

Finally, as shown in block 60, the finished pipe 10 is annealed to remove any stress that may have occurred in the glass due to uneven thermal changes. The pipe 10 is annealed by placing it in a kiln that has been set at approximately 1050° F. for about five minutes. The pipe is then allowed to gradually cool.

Although particular materials, equipment and supplies have been described for forming the pipe 10, it is to be understood that such is given by way of example, as other materials, equipment and supplies may be suitable.

Reasonable variation and modification are possible within the foregoing disclosure of the invention without departing from the scope of the invention.

What is claimed is:

1. A device for smoking combustible materials, comprising:

a tubular body member constructed entirely from a heat-resistant glass material having a longitudinal axis, a mouth end portion and a loading end portion opposite the mouth end portion;

a bore extending through the tubular body member between the mouth end portion and the loading end portion coaxial with the longitudinal axis;

a ring formed unitary with the tubular body member in the bore, the ring separating the bore into a smoke chamber and a loading chamber that are coaxial with the longitudinal axis, the ring defining a constricted passage between the smoke chamber and loading chamber.

2. A device according to claim 1 wherein the loading end portion comprises a beveled surface that extends from an outer surface of the tubular body member to the bore.

3. A device according to claim 2 and further comprising a cutting edge at the intersection of the beveled surface and the bore.

4. A device according to claim 3 and further comprising at least one gripping ring formed in the outer surface of the tubular body member adjacent the mouth end portion.

5. A device according to claim 1 wherein the loading end portion comprises a beveled surface that extends from an outer surface of the tubular body member to the bore.

6. A device according to claim 5 and further comprising a cutting edge at the intersection of the beveled surface and the bore.

7. A device according to claim 1 and further comprising at least one gripping ring formed in the outer surface of the tubular body member adjacent the mouth end portion.

8. A device for smoking combustible materials, comprising:

a tubular body member constructed entirely from a heat-resistant glass material, the tubular body member having a mouth end portion and a loading end portion opposite the mouth end portion;

a bore extending through the tubular body member between the mouth end portion and the loading end portion;

a venturi formed unitary with the tubular body member in the bore, the venturi separating the bore into a smoke chamber and a loading chamber and defining a constricted passage between the smoke chamber and loading chamber.

9. A device according to claim 8 wherein the loading end portion comprises a beveled surface that extends from an outer surface of the tubular body member to the bore.

10. A device according to claim 9 and further comprising a cutting edge at the intersection of the beveled surface and the bore.

11. A device according to claim 10 and further comprising at least one gripping ring formed in the outer surface of the tubular body member at the mouth end portion.

12. A device according to claim 8 and further comprising at least one gripping ring formed in the outer surface of the tubular body member adjacent the mouth end portion.

* * * * *